United States Patent [19]

Brady

[11] Patent Number: 4,944,510

[45] Date of Patent: Jul. 31, 1990

[54] EXERCISE APPARATUS

[76] Inventor: Dennis L. Brady, 2130 Huntington Dr., #311, S. Pasadena, Calif. 91030

[21] Appl. No.: 77,805

[22] Filed: Jul. 27, 1987

[51] Int. Cl.[5] ..... A63B 21/00

[52] U.S. Cl. ..... 272/133; 272/144; 272/131

[58] Field of Search ..... 272/131-134, 272/144, 145, 143, 93; 135/DIG. 9, 101, 106

[56] References Cited

U.S. PATENT DOCUMENTS

| | | | |
|---|---|---|---|
| 2,511,452 | 6/1950 | Anderson et al. | 135/DIG. 9 |
| 3,506,262 | 4/1970 | Wade | 272/133 |
| 3,752,472 | 8/1973 | Snead | 272/113 |
| 4,385,760 | 5/1983 | Mattox et al. | 272/131 |
| 4,421,307 | 12/1983 | Cunnington et al. | 272/133 |
| 4,519,605 | 5/1985 | Leland | 272/134 |
| 4,564,193 | 1/1986 | Stewart | 272/144 |
| 4,690,400 | 9/1987 | Metz | 272/132 |

FOREIGN PATENT DOCUMENTS

| | | | |
|---|---|---|---|
| 2592312 | 7/1987 | France | 272/109 |

*Primary Examiner*—Richard J. Apley
*Assistant Examiner*—J. Welsh
*Attorney, Agent, or Firm*—Boniard I. Brown

[57] ABSTRACT

An exercise apparatus which may be utilized to perform a variety of exercise routines and provides a frictional force for resisting the exercise movements of the user. The preferred apparatus has a unique modular construction which permits assembly of the apparatus in a variety of configurations for performing the various exercise routines. The apparatus may also be disassembled for storage, ease of transportion, and marketing of the apparatus in kit form. A novel friction rope brake mechanism for the exercise apparatus and other uses.

18 Claims, 3 Drawing Sheets

18a
44
62
60
72
68
76
88
84
14
86
81
70
48
13
56
52
3
16
54
67
20
46
18d
9
58
66
78
64
18b
18a
18d
9
18a
38
42

18a
40
14
44
62
60
68
88
84
86
48
16
54
46
18b
18d
38
13
18a
18d
42
54
46
10
18b
89
90
18b
18c
B
90
18c
18b
18c
96
90
18a
A
5
36
5
18a
90
C
18a
18b
18c
12

EXERCISE APPARATUS

BACKGROUND OF THE INVENTION

1. Field Of The Invention

This invention relates generally to exercise aids and more particularly to a novel exercise apparatus which may be utilized to perform a variety of weight-lifting like exercise routines and provides a frictional force, in place of weights, to resist the user's exercise movements. The invention relates also to a novel friction ropebrake mechanism for the exercise apparatus and other uses.

2. Prior Art

Exercising using weights and exercise machines to enhance the human physique are gaining ever increasing popularity with both men and women who are interested in improving their physical appearance and physical well-being. For this reason, a wide variety of exercising routines using weights and exercise machines have been devised each designed to exercise certain muscles. Among these exercise routines are the following:

(a) Raising and lowering a weight with the arms while standing or sitting. Raising a weight by squatting under the weight and then pressing up on the weight using the legs. These exercise routines exercise the deltoid, bicep, tricep, thigh, calf, and back muscles.

(b) A bench press exercise in which a weight is raised and lowered above the body using the arms while in a prone position. This routine exercises the pectoral muscles.

(c) A so-called flat flys exercise in which a weight is moved through a vertical arch, using one outstretched arm at a time, between a lower position at the side of the body and an upper position over the chest. This routine exercises the chest and shoulder muscles.

(d) While in a prone or semi-prone position, and using one arm at a time or both arms, moving a weight in a vertical arch between a lower position above the head and an upper position over the chest. This routine exercises the back and chest muscles.

(e) A rowing exercise in which a person sits in an upright position in a moveable seat grasping an exercise member such as a bar, with his feet on a footrest, moves the exercise member back and forth against the resisting force while simultaneously extending and contracting his legs in a simulated rowing motion. This routine exercises the arm, leg, back, chest, and shoulder muscles.

(f) A leg press exercise in which a person performs essentially a knee bend exercise against the resisting force. This routine exercises the leg, thigh, and calf muscles.

(g) A leg extension exercise in which a person, while in a sitting position, moves his lower leg portions between extended and retracted positions against the resisting force by bending the legs at the knees. This routine exercises the thigh.

Exercise routines of the kind mentioned above, as well as many other exercise routines, are performed with the aid of barbells, dumbells, and/or a variety of exercise machines. These existing exercise aids have certain disadvantages which this invention overcomes. Among the foremost of these disadvantages are the following: The necessity of using many different types of aids to perform a variety of exercise routines; the inability to vary the configuration of the exercise machine to accommodate a wide variety of exercise routines; the inability of the exercise machines to be disassembled for storage and transportation and the difficulty of storing and transporting exercise weights because of their heavy, bulky mass.

SUMMARY OF THE INVENTION

This invention provides an improved exercise apparatus which overcomes the above and other disadvantages of the existing exercise aids. According to one aspect of the invention, the force for resisting the exercise movements of the user in the performance of his exercise routines on the apparatus is a frictional force provided by a novel friction brake mechanism. The use of a frictional force, rather than weights, to provide a resisting force for the exercise routines eliminates the problems associated with handling, storing and transporting exercise weights because of their heavy, bulky mass.

According to another aspect of the invention, the present improved exercise apparatus has a unique modular construction which provides a two-fold benefit. First, the modular construction of the exercise apparatus permits the configuration or arrangement of the apparatus to be varied to adapt the apparatus to a wide variety of exercise routines including but not limited to the exercise routines (a) through (e) described above. Secondly, the modular construction of the exercise apparatus permits the latter to be quickly and easily disassembled for storage and transportation and to be easily reassembled for use.

The presently preferred modular exercise apparatus of the invention includes a frame, a member, referred to herein as an exercise member, movable relative to the frame by the user in the performance of the exercise routines, and a novel friction brake mechanism for providing a frictional force to resist movement of the exercise member relative to the frame. The apparatus is constructed on tubular sections which may be releasably joined with various configurations to form a modular frame and modular exercise member for the apparatus. These modular sections of the apparatus may be quickly and easily disassembled for storage and transportation and easily assembled for use in any of its possible configurations.

An additional important feature of the invention resides in the novel friction brake mechanism which is particularly useful on the exercise apparatus but may be used for other purposes as well. This friction brake mechanism is a rope brake mechanism including an elongated flexible friction member, referred to herein as a rope, wound about a rotary drum with the rope ends extending from the drum for attachments to fixed joints of the apparatus. The drum is free-wheeling, i.e., freely rotatable, in one direction only. One end portion of the rope leading from the drum is engaged by a frictional rope gripping means which is operable by the user of the apparatus to apply an adjustable frictional gripping force to the rope.

During use of this preferred exercise apparatus of the invention, movement of the exercise member relative to the frame causes movement of the member along the rope of the friction brake mechanism in such a way that the rope undergoes relative endwise movement about the brake drum and through the frictional rope gripping means. The rope frictionally engages the drum in such a way that relative movement of the rope about the drum during movement of the exercise member along the rope tends to rotate the drum in one direction or the other depending upon the direction of movement of the exercise member. Accordingly. movement of the exercise member in a direction which tends to turn the drum in its free-wheeling direction causes free rotation of the drum with essentially no slippage of the rope and drum. Accordingly, the only resistance, if any, to movement of the exercise member in this direction is the gripping force, if any, applied to the rope by the rope gripping means. If this gripping force is zero, the exercise member is essentially freely movable relative to the frame of the exercise apparatus.

During reverse movement of the exercise member, the rope tends to rotate the drum in the opposite direction. The drum is restrained against rotation in this direction, however, so that the rope slips about the drum. This slippage is resisted by the friction between the drum and rope to provide a frictional force which resists movement of the exercise member. An additional frictional force resisting movement of the exercise member may be provided by the user actuating the rope gripping means to exert on the rope a frictional gripping force which may be varied to vary the total frictional resisting force exerted on the exercise member.

Thus, during an exercise routine with the rope gripping means released, the exercise member is movable freely in one direction but it's movement in the opposite direction is frictionally resisted by the friction between the rope and drum. The rope gripping means may be actuated by the user in either or both directions of the exercise member to provide an adjustable resisting frictional force on the exercise member. For this reason, the rope gripping means is referred to herein as a user adjustable friction brake or simply an adjustable friction brake. As will be seen from the ensuing description, the friction brake mechanism of the invention is used in all the possible configurations of the present exercise apparatus to provide an adjustable frictional resisting force in all of the exercise routines which may be performed on the apparatus. While this friction brake mechanism is ideally suited for use on the apparatus, it may be used for other purposes as well.

DESCRIPTION OF THE PREFERRED EMBODIMENTS

Figure 2:
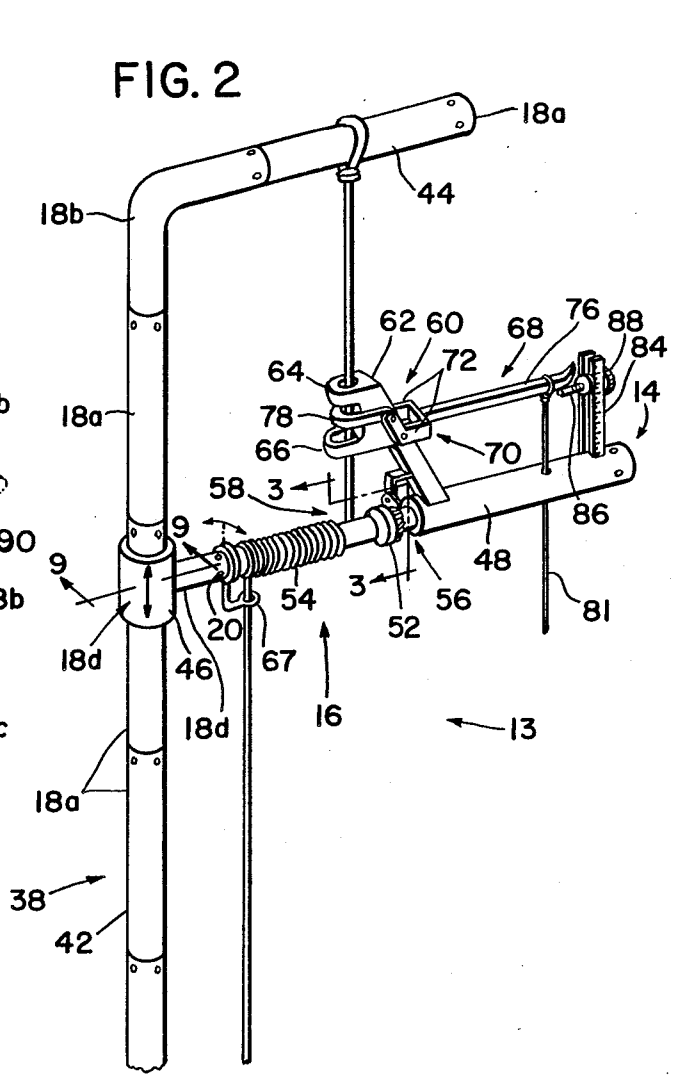
FIG. 2 is a fragmentary enlargement of FIG. 1.

Referring now to these drawings, and particularly to FIGS. 1 through 9, the exercise apparatus 10 of the invention has a frame 12, an exercise assembly 13 including an exercise member 14 supported on the frame for movement of the exercise member in an exercise movement by the user, and means 16 for frictionally resisting such movement of the exercise member. According to one important aspect of the invention, the resisting means 16 is a frictional brake mechanism which provides a frictional force for resisting the exercise movement of the exercise member 14. According to another important aspect of the invention, the exercise apparatus has a modular construction which permits it to be assembled in the various configurations, such as those of FIGS. 1, 10 and 11, to perform a variety of exercise routines.

Referring now in more detail to FIGS. 1 through 9 of the drawings, the illustrated exercise apparatus has a modular construction including a multiplicity of modules in the form of tubular sections 18 which may be releasibly assembled in a variety of configurations for use in performing the variety of exercise routines contemplated by the invention. These modular sections 18 include straight tubular sections **18*a*, tubular L sections 18*b*, tubular T sections 18*c*, and tubular bearing sections 18*d***.

Figure 5:
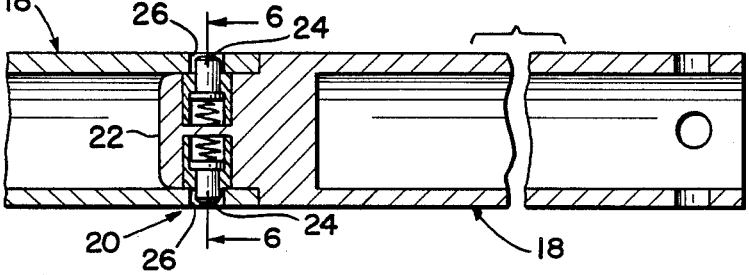
FIG. 5 is an enlarged section taken on line 5—5 in FIG. 1.
Figure 6:
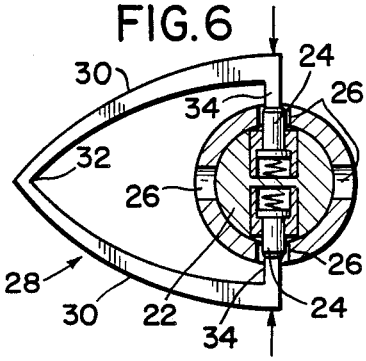
FIG. 6 is a section taken on line 6—6 in FIG. 5 illustrating a tool to aid disassembly of the apparatus.
Figure 12:
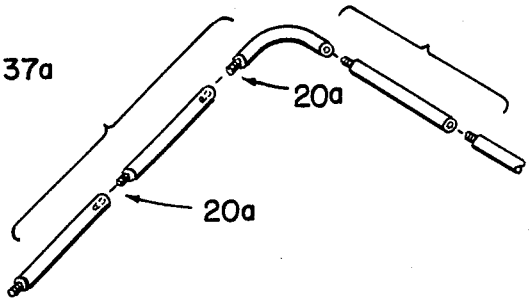
FIG. 12 is a partial perspective view of an embodiment wherein tubular sections are joined by threaded couplings.

Referring to FIGS. 5 and 6, the tubular section 18 and co-acting coupling means 20 are releasibly rigidly joining the sections to one another. Each coupling means 20 comprises a projecting co-axial plug 22 at one end of each section releasibly engageable, with a relatively snug fit, within the adjacent end of the adjacent section and spring loaded detents 24 in the plug engageable within sockets 26 in the adjacent section. When two tubular sections 18 are assembled in the manner shown in FIG. 5, they are rigidly co-axially joined to one another. FIG. 12 illustrates an alternative threaded coupling means 20a for joining the tubular sections.

The invention provides a tool 28 for releasing the coupling means 20 to permit separation of the tubular sections 18. This tool resembles tongs and has a pair of arms 30 flexibly joined at one end by a resilient hinged portion 32. At the opposite ends of the arms 30 are inwardly projecting, co-axial jaws 34 which are sized to fit somewhat loosely within the sockets 26 in the tubular sections 18. The arms 30 assume normal positions, wherein the hinged portion 32 is unstressed and the spacing between the jaws 34 is slightly greater than the diameter of the tubular sections 18.

To release a coupling means 20, the tool jaws 34 are disposed in straddling relation to a tubular section 18 with the jaws aligned with the sockets 26 in the section, as shown in FIG. 6. The tool arms 30 are then squeezed together to force their jaws 34 inwardly against the detents 24 in a manner which retracts the detents from their sockets and thereby free the tubular sections for axial separation. The tubular sections are joined by retracting the detents 24 into their plug 22 by hand or in any other convenient way and then forcing the plug into one end of a mating tubular section.

Figure 1:
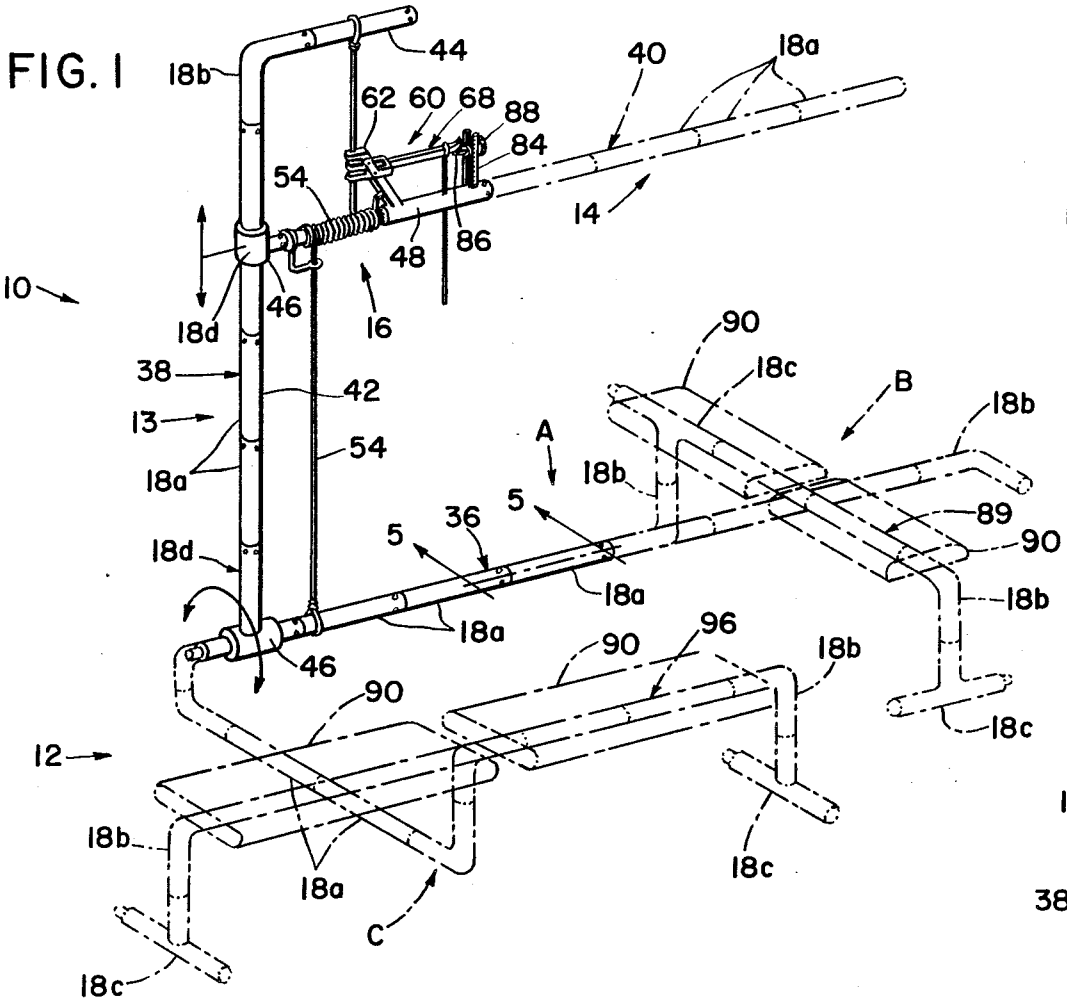
FIG. 1 is a prospective view of an exercise apparatus according to the invention configured for certain exercise routines.

The frame 12 of the exercise apparatus 10 in FIGS. 1 and 2 comprises a base 36 which supports the exercise assembly 13. This exercise assembly includes, in addition to the exercise member 14, a supporting guide 38 along which the exercise member is movable, in the manner explained below, and the friction brake mechanism 16. The brake mechanism is operative to frictionally resist movement of the exercise member 14 along the guide 38 as explained below. For some exercise routines, a number of the tubular sections 18 are coupled to the brake mechanism 16 to form an exercise bar 40.

It is significant to note here that the frame base 36 has three sections designated A, B, and C, which are used in the manner described later when performing different exercise routines. Base section A, is composed of several tubular straight sections 18*a* joined end-to-end to form, in effect, a long tube which may have an L section 18*b* at one end, as shown. The frame base sections B and C are coupled to the base section A, as shown in broken lines in FIG. 1, in order to adapt the exercise apparatus to various exercise routines, as will be explained.

The guide 38 of the exercise assembly 13 comprises an elongate guide portion 42 comprising a number of tubular sections 18*a* joined end-to-end and a horizontal end portion 44 comprising a tubular section 18*a* joined by a tubular L section 18*b* to the upper end of the guide portion 42. The opposite end of the guide portion 42 is coupled to the frame base portion A.

As will appear from the ensuing description, one exercise routine which may be performed on the exercise apparatus of FIG. 1 can be executed with the guide 38 either rigidly or rotatably attached to the frame base portion A. Other exercise routines which may be performed on the apparatus, however, require the guide 38 to rotate about the axis of the frame base portion A. For this reason the guide 38 is shown as being pivotally attached to the frame base portion A by a tubular bearing section 18*d*. The lower end of this bearing section is a bearing 46 (FIG. 9) which is rotatable on the base portion A, as indicated by the arrows in FIG. 1.

The exercise member 14 comprises the friction brake mechanism 16, a tubular bearing section or slides 18*d* which slides along the guide portion 42 of the exercise guide 38, and, when needed, the exercise bar 40. This exercise bar is composed of a number of the straight tubular sections 18*a* coupled end-to-end. The friction brake mechanism 16 is situated between the slide 18*d* and the exercise bar 40.

Brake mechanism 16 includes a tubular hand grip 48 which is coupled at one end to the adjacent end of the exercise bar 40 by coupling means 20. Extending co-axially from the opposite end of the tubular hand grip 48 is a shaft 50. Shaft 50 is releasibly joined by coupling means 20 to the tubular bearing section 18*d* of the exercise member 14. From this description, it is evident that the exercise member is movable laterally of the 5 axis of the exercise member and longitudinally along the guide 38.

The friction mechanism 16 may be uncoupled from tubular bearing section 18*d* by means of detents 20, thus to enable use of the mechanism independent of supporting guide 38. In this case, the guide functions simply as a support member.

Rotatable on the brake mechanism shaft 50 is a friction brake drum 52. Around this drum is wound a long flexible friction member 54, such as a rope. For convenience, this friction member is referred to herein as a rope. The ends of the rope 54 extend upwardly and downwardly from the brake drum 52. The upper rope end is secured to the upper horizontal end 44 of the guide 38. The lower rope end is secured to the frame section A. From this description, it is evident that during movement of the exercise member 14 along the guide 38, the rope 54 effectiVely undergoes relatively endwise movement about the drum 52.

Rope 54 is sufficiently taut that it frictionally engages the brake drum 52. Accordingly, relative endwise movement of the rope about the drum during movement of the exercise member 14 along the guide 38 tends to rotate the drum in one direction or the other depending upon the direction of movement of the exercise member along the guide. Downward movement of the exercise member in FIG. 1, for example, tends to rotate the drum 52 counter clockwise in FIG. 3. Upward movement of the exercise member tends to rotate the drum clockwise in FIG. 3.

Included in the friction brake mechanism 16 is a one-way clutch device 56 which locks the brake drum 52 against rotation in one direction but permits rotation of the drum in the opposite direction. The direction in which the brake drum is locked is referred to as it's locked direction. The direction in which the drum is free to rotate is referred to herein as it's free-wheeling direction. In the presently preferred embodiment illustrated, the clutch device 56 is a ratchet mechanism which locks a drum 52 against clockwise rotation in FIG. 3 and permits free counter clockwise rotation of the drum in FIG. 3.

Figure 3:
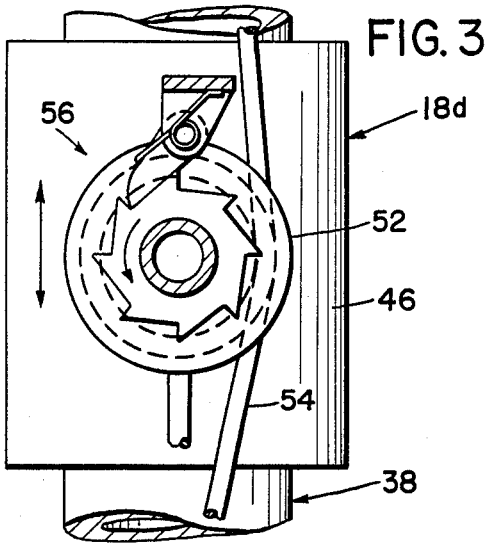
FIG. 3 is an enlarged section taken on line 3—3 of FIG. 2.

From this description, it will be understood that during downward movement of the exercise member 14 along the guide 38 in FIG. 1, relative endwise movement of the rope 54 about the drum 52 rotates the drum in it's counter clockwise or free-wheeling direction in FIG. 3. During upward movement of the exercise member, relative endwise movement of the rope about the brake drum 52 tends to rotate the drum in it's clockwise locked direction in FIG. 3. Since the drum is locked against rotation in this latter direction, the rope 54 slips about the drum 52 to produce a frictional force which resists upward movement of the exercise member. It will be understood, therefore, that the friction drum 52 and ratchet device 56 constitute a one-way frictional drum brake 58 which permits free downward movement of the exercise member 14 but frictionally resists upward movement of the member.

The friction brake mechanism 16 includes, in addition to the friction drum brake 58, a user actuated and adjustable friction brake 60. This user actuated brake is operable by a user while he is exercising to exert on the rope 54 a variable frictional gripping force which resists movement of the exercise member 14.

Figure 4:
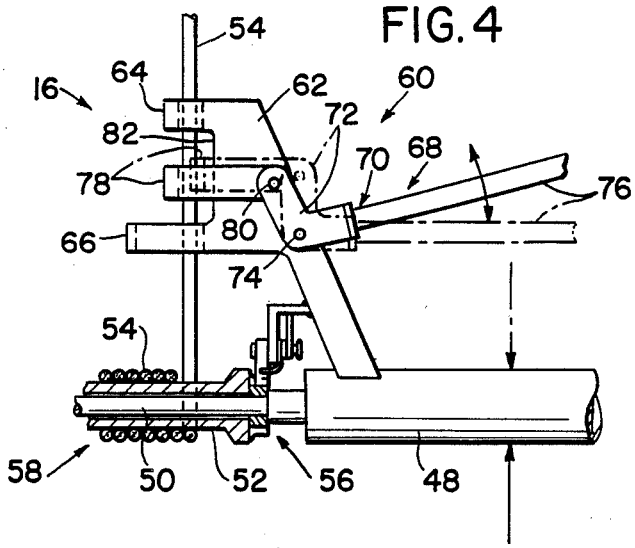
FIG. 4 is an enlargement, and side elevation, of a portion of FIGS. 1 and 2.

The user actuated brake 60 comprises a rope guide bracket 62 fixed to the tubular hand grip 48 of the friction brake mechanism 16. Guide bracket 62 has a pair of rope guides 64, 66 which are spaced along the rope 54 through which one end of the rope extends. The guide farthest from the brake guide 52, that is the upper guide 64 in FIG. 4, receives the rope 54 with a relatively close but free sliding fit. The guide nearest the brake drum 52, that is the loWer guide 66 in FIG. 4, is essentially a slot which is elongated parallel to the axis of the brake drum 52 to permit the upper rope end to move back and forth along the slot as the upper rope end winds onto and unwinds from the drum during movement of the exercise member 14 along the guide 38. A rope guide 67 at the end of brake drum 52 adjacent to coupling 18*d*, further insures orderly winding and unwinding of the rope.

In addition to the rope guides 64, 66 the user actuated brake 60 comprises an adjustable rope gripper 68. This rope gripper includes a bell crank 70 having a pair of arm 72 (only one shown) at one end which straddle the rope guide bracket 62 and are pivoted at 74 on the bracket. The opposite end of the bell crank 70 is a relatively long lever or handle 76 which extends generally lengthwise of and is spaced laterally from the tubular hand grip 48 of the brake mechanism 16.

Located between the rope guides 64, 66 is a U-shaped rope gripping yoke or jaw 78 whose arm straddle the rope guide bracket 62 and are pivotally attached at 80 to the free ends of the bell crank arm 72. With rotation of the bell crank handle lever 76 toward the hand grip 48 of the brake mechanism 16, from the solid line position of the lever to it's broken line position in FIG. 4 pulls the rope gripping yoke or jaw 78 to the right in FIG. 4 to frictionally grip the rope 54 between the jaw and the face 82 of the rope guide bracket 62 between the rope guides 64, 66. The lever handle 76 is resiliently flexible to bend to some degree as the force on the handle is increased to exert a frictional gripping force on the rope 54. This frictional gripping force may be varied by varying the force applied to the lever handle by the user. A line 81 depends from lever handle 76 for manual grasping to enable a person to apply resistance load when the resistance member is stationary and out of manual reach.

Next to the tubular hand grip 48 of the exercise member 14 is an upstanding bracket 84. Adjustable along this bracket is a screw 86 disposed in the path of the brake handle 76. This screw carries a nut 88 for securing the screw in fixed position onto the bracket 84. The screw forms an adjustable stop engageable by the brake handle 76 to limit the frictional gripping force applied to the rope 54 by the user actuated brake 60. In order to maintain a pre-set tension, lever handle 76 may be positioned under the screw 86 by disengaging nut 88, removing the screw, then replacing the screw and nut with the screw disposed above the end portion of lever handle 76.

The exercise apparatus described to this point can be used to perform an exercise routine in which the user stands in the frame base A and grips the exercise member 14 with either one or both hands. When using one hand, the user grips the hand grip 48 of the friction drum brake 58. When using both hands, additional tubular sections **18*a* are joined end-to-end to the hand grip 48 to form the exercise bar 40. The user then grips the hand grip 48 with one hand and the exercise bar 40 with the other hand. In either case, one or more fingers of the hand gripping the hand grip 48 are engaged over the brake handle 76 to operate the adjustable, user actuated brake 60**.

The user then moves the exercise member 14 up and down along the guide 38. If the user actuated, adjustable brake 60 is released, the up and down motion of the exercise member is resisted only by the frictional force exerted by the drum brake 58 during upward movement of the member. By actuating the adjustable brake 60, the user can augment the frictional resisting force of the drum brake 58 during upward movement of the exercise member 14 and/or produce a frictional force resisting downward movement of the exercise member.

It should be noted here that while the illustrated brake 58 is arranged, by virtue of it's ratchet 56, to produce a frictional resistance to upward movement of the exercise member 14, the ratchet could be reversed to produce a frictional resistance to downward movement of the exercise member. Alternatively, the brake drum 52 could be fixed against rotation in both directions to produce a frictional resistance to both up and down movement of the exercise member 14, or the ratchet mechanism 56 could be replaced by one which is operable to selectively lock the brake drum 52 against rotation in either or both directions to frictionally resist, selectively, either or both up and down movement of the exercise member.

The above-described exercise routine exercises the deltoid, bicep, tricep, thigh, calf and back muscles.

Figure 7:
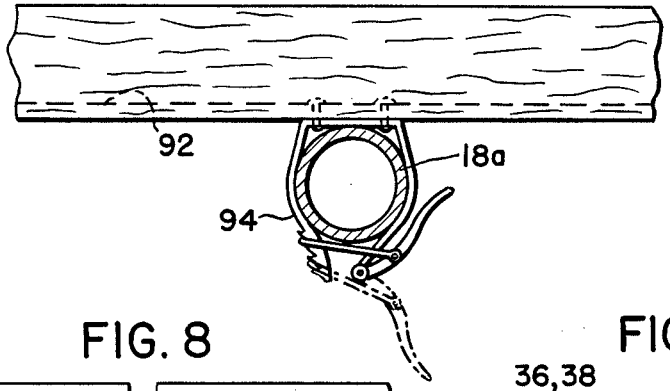
FIG. 7 is an enlargement of a seat used on the exercise apparatus and illustrating particularly the manner in which the seat is attached to the apparatus frames.
Figure 8:
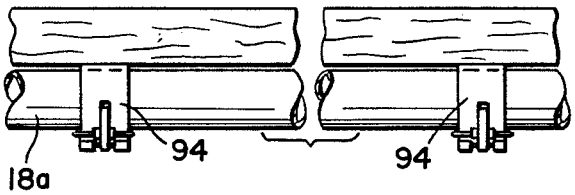
FIG. 8 is an enlarged side view of FIG. 7.
Figure 9:
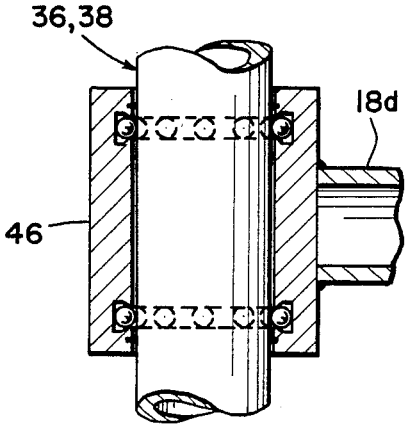
FIG. 9 is an enlarged section taken on line 9—9 in FIG. 2.

Frame section B may be added to base section A, to adapt the exercise apparatus to another exercise routine. Base section B comprises tubular straight sections **18*a*, L sections 18*b*, and T sections 18*c* which are coupled to one another and to the base section A to form a frame base having an elevated horizontal portion 89 transverse to the base A. Supported on this elevated frame base portion are pads 90 on which the user may lie face up. Referring to FIGS. 7 and 8, these pads have a rigid back plate 92 to which are secured clamps 94 for releasibly clamping the pad to the upper horizontal portion 89** of the frame based section B.

A user lies on the pads 90 with his head below the exercise member 14. He then reaches up to grasp the exercise member with both hands and moves the member up and down in a manner simulating a conventional bench press exercise. This routine exercises the pectoral, arm and shoulder muscles.

The frame base section C may be added to the base section A to perform yet another exercise routine. Base section C comprises tubular straight sections **18*a*, L sections 18*b* and T sections 18C which are coupled to one another and to the base section A in the manner as shown to provide an elevated horizontal portion 96 parallel to and spaced laterally from the base section A. Clamped to the horizontal portion 96 are pads 90 on which the user may lie face up. The user grips the exercise member 14 with the hand nearest the member and moves the member in a vertical arch between a lower position at the side of the user's body and an upper position over the user's chest. This exercise simulates a conventional "flat flys" which exercises the user's chest, arm, and shoulder muscles. During this exercise routine, the guide 38 for the exercise member 14** rotates back and forth about the frame base section A.

Figure 10:
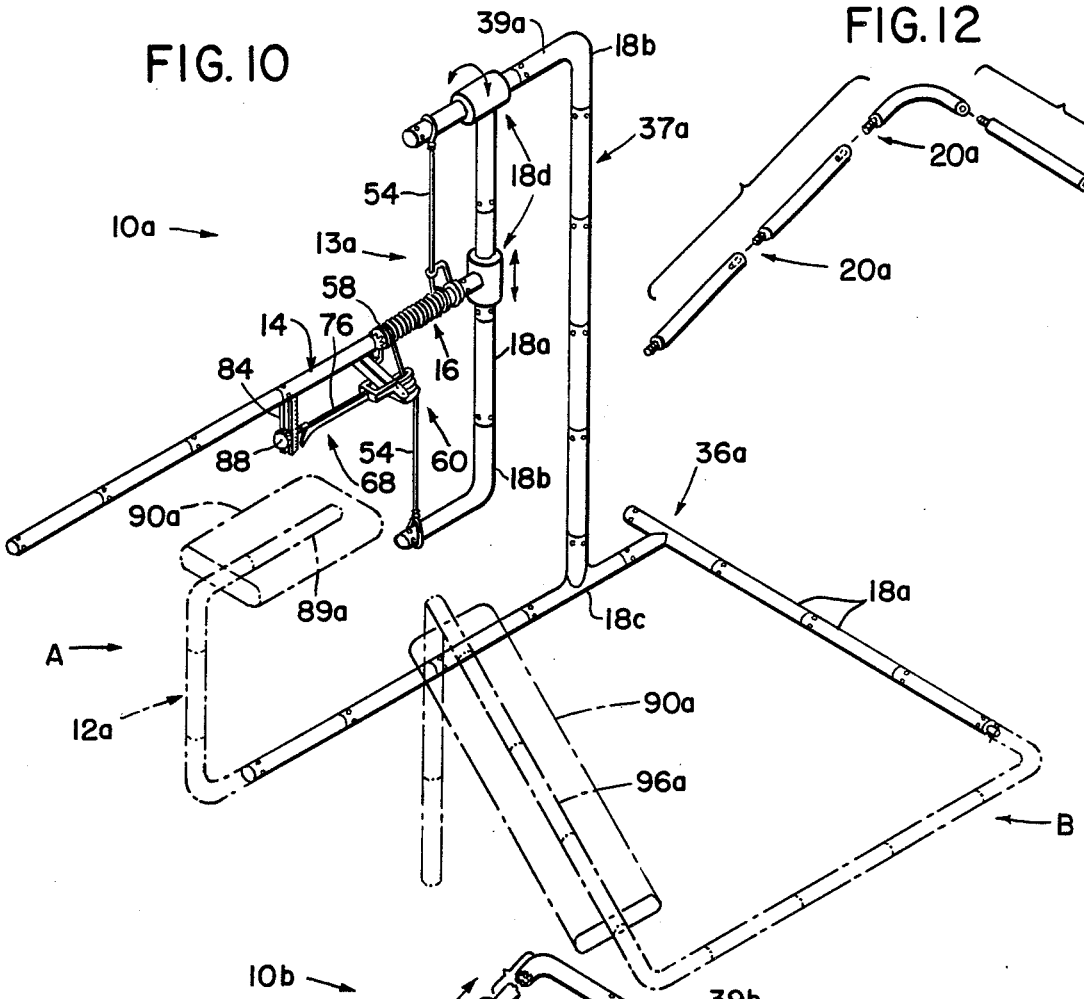
FIGS. 10 and 11 illustrate two possible alternative configurations of the apparatus.
Figure 11:
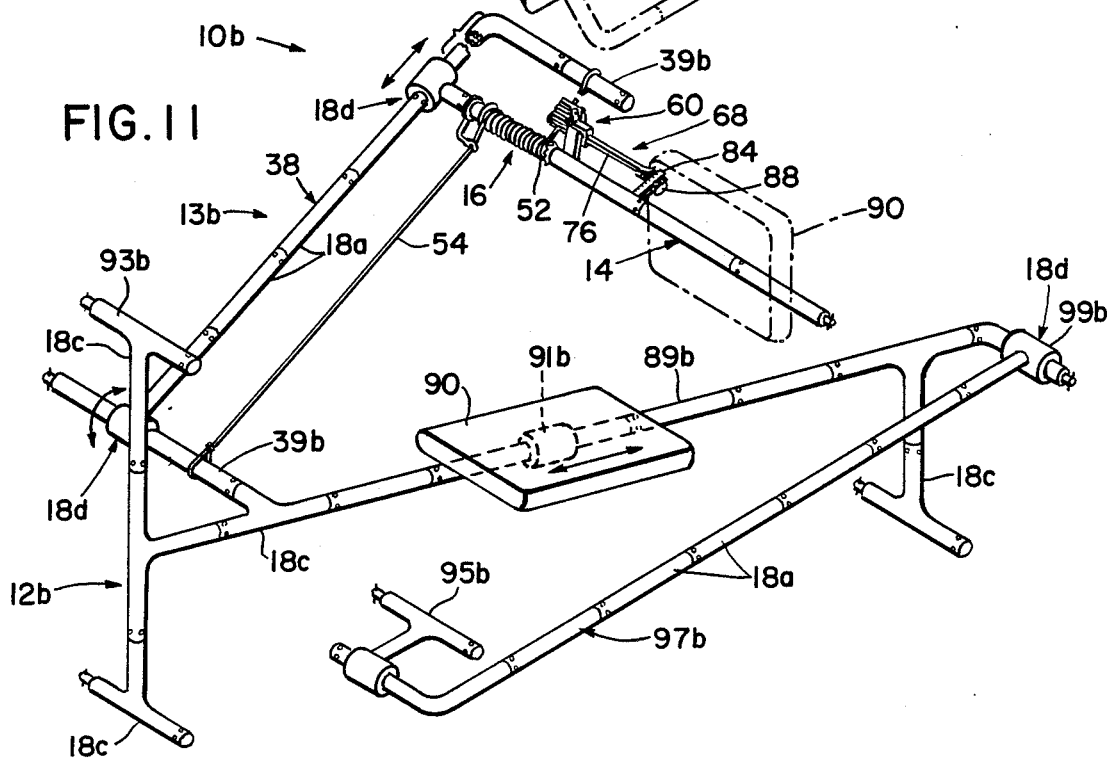

The frame base section C and it's pad 90 may obviously be arranged to permit the use to grip the exercise member 14 with either hand. Moreover, it will be obvious at this point that the exercise apparatus of the invention may be assembled in many different configurations, by appropriate assembly of the tubular frame sections **18*a*, 18*b*, 18*c*, and 18*d*, to perform many other exercise routines than those described above. FIGS. 10 and 11** illustrate two possible alternative configurations of the apparatus.

In FIG. 10, the frame **12*a* of the exercise apparatus 10*a* includes a base 36*a* and an upright 37*a* having a horizontal extension 39*a* at its upper end. Rotatably supported at it's upper end on this extension 39*a* is an exercise assembly 13*a*. Exercise assembly 13*a* is identical to the exercise assembly 13 except that the latter is supported in an upright position while the former hangs in an inverted position. For this reason, the various parts of the exercise assembly 13*a* are designated by the same reference numerals as the corresponding parts of the exercise assembly 13. The upper end of the rope 54 of the exercise assembly 13***a* is secured to the frame upright extension 39*a*.

The frame base 36*a* of the exercise apparatus 10*a* includes two sections A and B, shown in broken lines, for use in performing different exercise routines. Frame section A includes an elevated horizontal portion 89*a* supporting a pad 90*a* below the exercise member 14 on which the user may sit. Frame section B includes an elevated inclined portion 96*a* supporting a pad 90*a* on which a user may lie face up with his head nearest the exercise member 14. The exercise apparatus of FIG. 10 can be used in different ways. One exercise routine Which can be performed, for example, is that commonly referred to as push downs for exercising the triceps. In this exercise, the user stands next to the exercise member 14 and pushes doWn on the member. In this regard, it is significant to note that since the exercise assembly 13*a* hangs in an inverted position, the drum break 58 resists downward movement of the exercise member !4 rather than upward movement of the member as in the exercise apparatus of FIGS. 1 through 9.

An exercise routine commonly referred to as pull downs, for exercising the lats may be performed by coupling the base section A to the apparatus. The user then sits on the cushion 90 and pulls down on the exercise member 14.

Another exercise routine which can be performed on the apparatus of FIG. 10 simulates a conventional pullover exercise for exercising the lat muscles. This exercise can be performed by coupling the base section B to the apparatus. The user lies on the pad 90 with his head to one side of the exercise member 14. The user then reaches over or back of his head to grip the exercise member 14 and moves the member through an arch betWeen a position over or behind his head and a position over his chest. During this exercise, the exercise assembly 13*a* rotates back and forth about the horizontal extension 39*a* of the frame upright 37*a*.

FIG. 11 illustrates an exercise apparatus according to the invention assembled in a configuration suitable for performing rowing and leg extension exercises. The apparatus 10*b* comprises a frame 12*b* including an elongate elevated portion or truck 89*b* and a horizontal extension 39*b* projecting laterally from the track 89*b* adjacent one end thereof. Rotatably fitted on the extension 39*b* is an exercise assembly 13*b* identical to the exercise assembly 13 described earlier. One end of the rope 54 of the exercise assembly is secured to the extension 39*b*.

Movable along the elevated track 89*b* is a bearing 91*b* to which is fixed a pad 90. The user sits on this pad with his feet engaging in upright footrest 93*b* formed by a tubular key section 18*c* at the end of the track 89*b* adjacent to the extension 39*b*.

In the rowing exercise, the user sits on the pad 90 with the exercise member 14 in front of his body and with his feet engaging the footrest 93*b*. The user then exercises a rowing action in which he alternately pushes the exercise member 14 towardly along the guide 38 (in it's free-wheeling direction) with his arms which drawing his body forwardly along the track 89*b* by bending his knees and then pulls back on the exercise member with his arms while pushing his body back along the track 89*b* by straightening his legs. His rowing routine is effective to exercise numerous body muscles including the arm, leg, shoulder and back muscles.

Another exercise routine which can be performed on the exercise apparatus of FIG. 11 is similar to a conventional leg press exercise. In this exercise, the user sits on the pad 90 with his feet against the footrest 93*b*, as in the rowing exercise, but with the exercise member 14 behind his back. The user then uses his legs to push the exercise member rearwardly in a manner similar to a leg press. If desired, the pad 90 may be secured to the exercise member 14 for contact with the user's back.

Another exercise routine which may be performed on the exercise apparatus of FIG. 11 uses a foot support 95*b* on one end of an elongate tubular member 97*b*. The opposite end of the member 97*b* mounts a bearing 99*b* rotatably mounted on the adjacent end of the frame 12*b*. In a leg extension exercise, the user sits on the pad 90 with the exercise member 14 behind his back, in the same manner as the leg press exercise just described. The user engages his feet under the cross bar of the foot support 95*b* and forces his body back along the track 89*b* by straightening his legs. This exercise routine exercises the user's thigh muscles.

It will be understood that all of the apparatus configurations described above are constructed by appropriate assembly of the modular components or tubular sections 18*a*. Moreover, it will be obvious that these modular components may be assembled in a wide variety of other configurations suitable for performing many other exercise routines.

In all of these exercise routines which may be performed on the exercise apparatus of the invention, the friction brake mechanism 16 creates a frictional force resisting the exercise motions executed by the user. This frictional resisting force is adjustable by actuating of the adjustable brake 60 by the user, in the manner explained earlier.

The inventor claims:

1. An exercise apparatus comprising:

a base member, a support member including an elongate portion having normally upper and lower ends, and an end portion extending laterally from one end of said elongate portion, means at the other end of said elongate portion of said support member mounting said support member on said base member, a rope having one end secured to said laterally extending end portion of said support member, its other end secured to said base member, and an intervening portion extending between said upper and lower ends of and spaced laterally from said elongate portion of said support member, an exercise member movable in an exercise motion back and forth along said intervening portion of said rope, and friction brake means on said exercise member frictionally engageable with said rope for resisting said exercise motion.

2. An exercise apparatus comprising:

a base member, a support member including an elongate portion having normally upper and lower ends, and an end portion extending laterally from one end of said elongate portion, means at the other end of said elongate portion of said support member mounting said support member on said base member, a rope having one end secured to said laterally extending end portion of said support member, its other end secured to said base member, and an intervening portion extending between said upper and lower ends of and spaced laterally from said elongate portion of said support member, an exercise member movable in an exercise motion back and forth along said intervening portion of said rope, friction brake means on said exercise member frictionally engageable with said rope for resisting said exercise motion, and at least one of said members comprising tubular sections, and coupling means releasibly joining said tubular sections end to end to permit assembly of said exercise apparatus in different configurations for performing different exercise routines and disassembly of the apparatus for ease of storage.

3. An exercise apparatus according to claim 2, wherein:

said exercise member includes a slide slidable on said elongate portion of said support member, whereby said support member forms a guide for guiding said exercise member in its back and forth exercise motion along said rope.

4. An exercise apparatus according to claim 2, wherein:

said exercise member comprises a grip portion to be grasped by a user of the exercise apparatus and a portion for mounting said friction brake means, a slide slidable on said elongate portion of said support member, and means releasibly connecting said grip portion and slide, whereby said support member forms a guide for guiding said exercise member in its back and forth exercise motion along said rope, and said grip portion and slide are separable to permit exercise motion of said grip portion without guidance of said grip portion on said support member.

5. An exercise apparatus according to claim 2, wherein:

said friction brake means comprises a drum rotatably mounted on said exercise member and having a circumferential friction surface around which said intervening rope portion is wound, and means for releasibly securing said drum against rotation, whereby during said exercise motion of said exercise member with said drum secured against rotation, said rope slides about said drum surface to frictionally resist said exercise motion, and during said exercise motion of said exercise member with said drum released for rotation, said rope rotates the drum to permit relatively free exercise motion of said exercise member.

6. An exercise apparatus according to claim 2, wherein:

said friction brake means comprises means on said exercise member operable by a person using said exercise apparatus for frictionally gripping said rope with an adjustable gripping force.

7. An exercise apparatus according to claim 2, wherein:

said friction brake means comprises a drum rotatably mounted on said exercise member and having a circumferential friction surface around which said intervening rope portion is wound, and means for releasbily securing said drum against rotation, whereby during said exercise motion of said exercise member with said drum secured against rotation, said rope slides about said drum surface to frictionally resist said exercise motion, and during said exercise motion of said exercise member with said rum released for rotation, said rope rotates the drum to permit relatively free exercise motion of said exercise member, and means on said exercise member operable by a person using said exercise apparatus for frictionally gripping said rope with an adjustable gripping force.

8. An exercise apparatus according to claim 2, wherein:

said exercise member comprises an elongate grip portion extending laterally of said elongate portion of said support member and adapted to be grasped by a person using said exercise apparatus, said friction brake means comprises a drum coaxially rotatably mounted on said grip portion and having a circumferential friction surface around which said intervening rope portion is wound, and means for releasibly securing said drum against rotation, whereby during said exercise motion of said exercise member with said drum secured against rotation, said rope slides about said drum surface to frictionally resist said exercise motion, and during said exercise motion of said exercise member with said drum released for rotation, said rope rotates the drum to permit relatively free exercise motion of said exercise member, and means on said exercise member operable by a person using said exercise apparatus for frictionally gripping said rope with an adjustable gripping force.

9. An exercise apparatus according to claim 8, wherein:

said exercise member includes a slide slidable on said elongate portion of said support member and means connecting said grip portion and slide, whereby said support member forms a guide for guiding said exercise machine in its back and forth exercise motion along said rope.

10. An exercise apparatus according to claim 9, wherein:

said means connecting said grip portion and slide is releasible to permit separation of said grip portion from said slide for exercise motion of said grip portion without guidance of said grip portion on said support member.

11. An exercise apparatus according to claim 10, wherein:

each of said members comprises tubular sections, and coupling means releasibly joining said tubular sections end to end to permit assembly of said exercise apparatus in different configurations for performing different exercise routines and disassembly of the apparatus for ease of storage.

12. An exercise apparatus according to claim 2, wherein:

said means for mounting said support member on said base member comprises pivot means which permits back and forth movement of said support member about a pivot axis at said other end of said elongate portion of said support member during exercise motion of said exercise member along said rope.

13. An exercise apparatus according to claim 12, wherein:

said laterally extending end portion of said support member and said pivot means are at the upper and lower ends, respectively, of said elongate portion of said support member, and said base member includes means for mounting a bench above the level of said pivot means to support a person using said apparatus.

14. An exercise apparatus according to claim 12, wherein:

said laterally extending end portion of said support member and said pivot means are at the lower and upper ends, respectively, of said elongate portion of said support member, and said base member includes means for mounting a bench below the level of said pivot means to support a person using said apparatus.

15. An exercise apparatus according to claim 12, wherein:

said base member includes an elongate track, footrest at one end of said track, and a seat movable back and forth along said track for supporting a person using said exercise apparatus with his feet engaging said footrests, and said pivot means is located at said one end of said track, whereby a person may use said apparatus to perform a rowing exercise routine.

16. An exercise apparatus according to claim 13, wherein;

said exercise member comprises a elongate grip portion extending laterally of said elongate portion of said support member and adapted to be grasped by a person using said exercise apparatus, said friction brake means comprises a drum rotatably mounted on said exercise member and having a circumferential friction surface around which said intervening rope portion is wound, and means for releasibly securing said drum against rotation, whereby during said exercise motion of said exercise member with said drum secured against rotation, said rope slides about said drum surface to frictionally resist said exercise motion, and during said exercise motion of said exercise member with said drum released for rotation, said rope rotates the drum to permit relatively free exercise motion of said exercise member, and means on said exercise member operable by a person using said exercise apparatus for frictionally gripping said rope with an adjustable gripping force, said exercise member includes a slide slidable on said elongate portion of said support member, and means releasibly connecting said grip portion and slide, whereby said support member forms a guide for guiding said exercise machine in its back and forth exercise motion along said rope, and said grip portion is separable from said slide for exercise motion of said grip portion without guidance of said grip portion on said support member, and each of said members comprises tubular sections, and coupling means releasibly joining said tubular sections end to end to permit assembly of said exercise apparatus in different configurations for performing different exercise routines and disassembly of the apparatus for ease of storage.

17. An exercise apparatus according to claim 14, wherein:

said exercise member comprises an elongate grip portion extending laterally of said elongate portion of said support member and adapted to be grasped by a person using said exercise apparatus, said friction brake means comprises a drum rotatably mounted on said exercise member and having a circumferential friction surface around which said intervening rope portion is wound, and means for releasibly securing said drum against rotation, whereby during said exercise motion of said exercise member with said drum secured against rotation, said rope slides about said drum surface to frictionally resist said exercise motion, and during said exercise motion of said exercise member with said drum released from rotation, said rope rotates the drum to permit relatively free exercise motion of said exercise member, and means on said exercise member operable by a person using said exercise apparatus for frictionally gripping said rope with an adjustable gripping force, said exercise member includes a slide slidable on said elongate portion of said support member, and means releasibly connecting said grip portion and slide, whereby said support member forms a guide for guiding said exercise machine in its back and forth exercise motion along said rope, and said grip portion is separable from said slide for exercise motion of said grip portion without guidance of said grip portion on said support member, and each of said members comprises tubular sections, and coupling means releasibly joining said tubular sections end to end to permit assembly of said exercise apparatus in different configurations for performing different exercise routines and disassembly of the apparatus for ease of storage.

18. An exercise apparatus according to claim 15, wherein:

said exercise member comprises an elongate grip portion extending laterally of said elongate portion of said support member and adapted to be grasped by a person using said exercise apparatus, said friction brake means comprises a drum rotatably mounted on said exercise member and having a circumferential friction surface around which said intervening rope portion is wound, and means for releasibly securing said drum against rotation, whereby during said exercise motion of said exercise member with said drum secured against rotation, said rope slides about said drum surface to frictionally resist said exercise motion, and during said exercise motion of said exercise member with said drum released for rotation, said rope rotates the drum to permit relatively free exercise motion of said exercise member, and means on said exercise member operable by a person using said exercise apparatus for frictionally gripping said rope with an adjustable gripping force, said exercise member includes a slide slidable on said elongate portion of said support member, and means releasibly connecting said grip portion and slide, whereby said support member forms a guide for guiding said exercise machine in its back and forth exercise motion along said rope, and said grip portion is separable from said slide for exercise motion of said grip portion without guidance of said grip portion on said support member, and each of said members comprises tubular sections, and coupling means releasibly joining said tubular sections end to end to permit assembly of said exercise apparatus in different configurations for performing different exercise routines and disassembly of the apparatus for ease of storage.

* * * * *